US012662902B2

(12) United States Patent
Kundapur et al.

(10) Patent No.: US 12,662,902 B2
(45) Date of Patent: Jun. 23, 2026

(54) DIFFERENTIAL BACK PRESSURE VALVE FOR CARBON CAPTURE AND UTILIZATION

(71) Applicant: Schlumberger Technology Corporation, Sugar Land, TX (US)

(72) Inventors: Karthik Kundapur, Rosharon, TX (US); Vinod Chakka, Rosharon, TX (US); Arun Arumugam, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 52 days.

(21) Appl. No.: 18/891,954

(22) Filed: Sep. 20, 2024

(65) Prior Publication Data

US 2025/0101831 A1 Mar. 27, 2025

Related U.S. Application Data

(60) Provisional application No. 63/584,193, filed on Sep. 21, 2023.

(51) Int. Cl.
*E21B 34/10* (2006.01)
*E21B 41/00* (2006.01)

(52) U.S. Cl.
CPC ..... *E21B 34/10* (2013.01); *E21B 41/0064* (2013.01); *E21B 2200/02* (2020.05)

(58) Field of Classification Search
CPC ... E21B 34/10; E21B 41/0064; E21B 2200/02
See application file for complete search history.

(56) References Cited

U.S. PATENT DOCUMENTS

| | | | | |
|---|---|---|---|---|
| 2,642,812 | A * | 6/1953 | Robinson | E21B 43/122 137/155 |
| 3,722,527 | A * | 3/1973 | Blackwell | E21B 43/123 137/155 |
| 4,390,068 | A * | 6/1983 | Patton | E21B 43/18 166/305.1 |
| 5,337,828 | A * | 8/1994 | Jennings, Jr. | E21B 43/164 166/372 |
| 2007/0034377 | A1* | 2/2007 | Moyes | E21B 43/123 166/305.1 |
| 2015/0233220 | A1* | 8/2015 | Tiong | E21B 43/123 29/890.12 |
| 2017/0254177 | A1* | 9/2017 | Woodford | E21B 34/08 |

* cited by examiner

*Primary Examiner* — Cathleen R Hutchins
(74) *Attorney, Agent, or Firm* — Kyle R. Miiller

(57) ABSTRACT

Systems and methods for injection fluid into a well or aquifer while regulating pressure. The systems and methods include a back pressure valve biased to a closed position. The back pressure opens when an injection pressure of the fluid exceeds a reference pressure. The back pressure valve controls pressure of the injection fluid above the back pressure valve to maintain the injection fluid in a dense state.

11 Claims, 7 Drawing Sheets

DIFFERENTIAL BACK PRESSURE VALVE FOR CARBON CAPTURE AND UTILIZATION

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application claims priority benefit of U.S. Provisional Application No. 63/584,193, filed Sep. 21, 2023, the entirety of which is incorporated by reference herein and should be considered part of this specification.

BACKGROUND

Field

The present disclosure generally relates to systems and methods for carbon capture and storage.

Description of the Related Art

Carbon Capture, Utilization, and Storage (CCUS), or Carbon Capture and Storage (CCS), refers to a set of technologies and processes designed to capture carbon dioxide ($CO_2$) emissions from industrial processes or power generation, utilize the captured $CO_2$ in various applications, and/or store the $CO_2$ underground to prevent it from entering the atmosphere and contributing to climate change. $CO_2$ injection is one option for reducing greenhouse effects. $CO_2$ can be injected into, for example, a well, depleted hydrocarbon reservoir, or aquifer.

SUMMARY

In some configurations, a back pressure valve includes a housing, a piston disposed in the housing, a power spring disposed in the housing and operably coupled to the piston, a stem disposed in the housing, a reference pressure port extending through the housing, and one or more flow ports in the housing. The housing defines a central bore extending to an opening in a downhole end of the housing. The housing includes an internal sealing surface and an internal seat. The piston is configured to seal against the internal sealing surface when the back pressure valve is in a closed position. The power spring is configured to bias the piston against the internal sealing surface. The stem is configured to seal against the internal seat in the closed position. The reference pressure port extends from an opening in an external wall of the housing to a chamber on an uphole end of the piston such that a reference pressure acts on the uphole end of the piston. The opening of the reference port is in communication with an annulus pressure or a control line from a surface location. The flow ports are configured to allow injection fluid to flow from outside of the back pressure valve into the central bore. The back pressure valve is configured to move to an open position when a pressure of the injection fluid exceeds a combination of the reference pressure and a spring force of the power spring.

When the pressure of the injection fluid exceeds the combination of the reference pressure and the spring force of the power spring, the piston shifts away from the internal sealing surface to open the valve. When the back pressure valve is in the open position, the back pressure valve can remain open over a range of injection pressures, such that an operating injection pressure can be less than the pressure required to move the valve to the open position. In the open position, a flow path for injection fluid extends through the flow ports into the central bore, through the stem, and through the opening in the downhole end of the housing. In the open position, the stem and internal seat function as a variable choke. As an operating injection pressure increases, the stem moves farther away from the internal seat, increasing a flow area through the central bore. The back pressure valve can include a biasing member disposed about the stem and configured to bias the stem toward the internal seat.

A system for injecting a fluid into a well or aquifer can include a tubing extending into or to the well or aquifer, the back pressure valve disposed at or near a lower end of the tubing, and a reference pressure path providing communication between the opening of the reference pressure port of the back pressure valve and the annulus outside the tubing or the control line from a surface location. The system can be configured for injection of $CO_2$. The system can further include a valve disposed at or near an upper end of the tubing, the valve configured to allow injection of the fluid into the tubing in use. The back pressure valve is configured to maintain a pressure sufficient to maintain fluid in the tubing in a dense state.

In some configurations, a system for injecting a fluid into a well or aquifer includes a tubing extending into or to the well or aquifer, a back pressure valve disposed at or near a lower end of the tubing and biased to a closed position, and a reference pressure path providing communication between the back pressure valve and an annulus outside the tubing or a control line from a surface location. The back pressure valve is configured to open when an injection pressure of fluid injected through the tubing exceeds pressure in the reference pressure path.

The system can be configured for injection of $CO_2$. The system can further include a valve disposed at or near an upper end of the tubing, the valve configured to allow injection of the fluid into the tubing in use. The back pressure valve is configured to maintain a pressure sufficient to maintain fluid in the tubing in a dense state.

In some configurations, a method for injecting fluid into a well or aquifer includes deploying a back pressure valve at or near a lower end of a tubing extending into or to the well or aquifer, establishing a threshold pressure configured to maintain the back pressure valve in a closed position, injecting the fluid into the well or aquifer at a pressure exceeding the threshold pressure, thereby opening the back pressure valve to an open position, and varying an injection rate of the fluid into the well or aquifer while maintaining the back pressure valve in the open position.

The method can include deploying and/or retrieving the back pressure valve via wireline. The threshold pressure can be established at least in part with reference to an annulus pressure or a control line to a surface location. The injection fluid can be $CO_2$.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1:
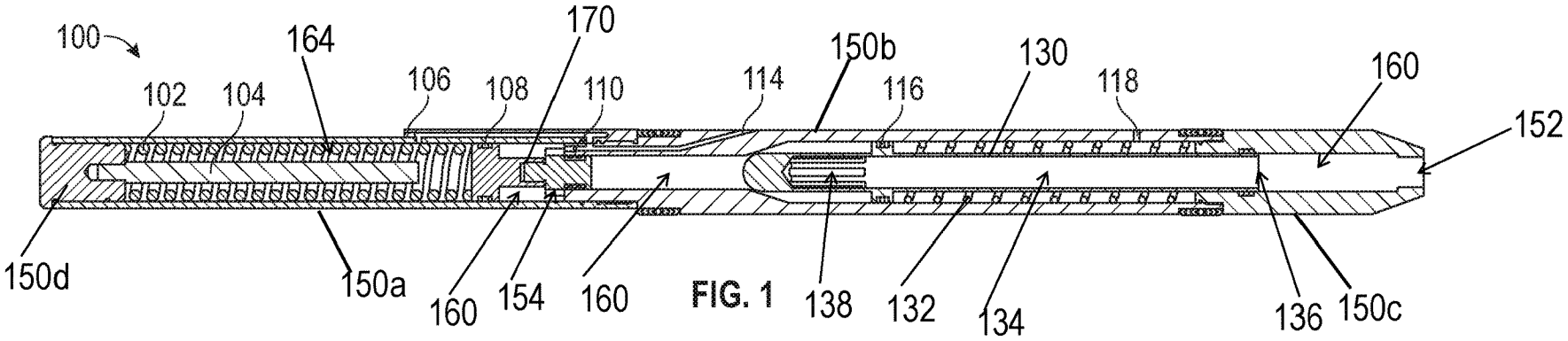
FIG. 1 shows a longitudinal cross-section of an example back pressure valve in a closed position.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

In addition, as used herein, the terms "real time", "real-time", or "substantially real time" may be used interchangeably and are intended to described operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed or are caused to be performed, for example, by a control system (i.e., solely by the control system, without human intervention).

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

The present disclosure generally relates to systems and methods for injection of fluids, such as $CO_2$ for CCS applications, and for regulation of pressure to avoid deleterious effects. The fluid can be injected into, for example, a well, depleted reservoir, saline aquifer, unmineable coal seam, or basalt formation. Although various configurations of the present disclosure are described with respect to injection of fluid into a well, systems and methods of the present disclosure can also or alternatively be used to inject fluid(s), such as $CO_2$, into a saline aquifer, unmineable coal seam, basalt formation, or any other $CO_2$ injection purpose or application.

The injected fluid may be delivered to the well (or, for example, reservoir, aquifer, coal seam, or basalt formation) through a completion in a dense phase (liquid or supercritical). However, if the injected fluid undergoes a liquid to gas transition in the completion, substantial and undesirable temperature drops and/or rapid expansion cooling may occur due to the phase transition energy transfer. The substantial temperature drops and/or rapid expansion cooling can detrimentally affect completion components and/or the surrounding wellbore wall. Detrimental effects may include cryogenically induced failures of metals, seals, or cement as well as the freezing of wellbore fluids and/or hydraulic fluids.

Figure 11:
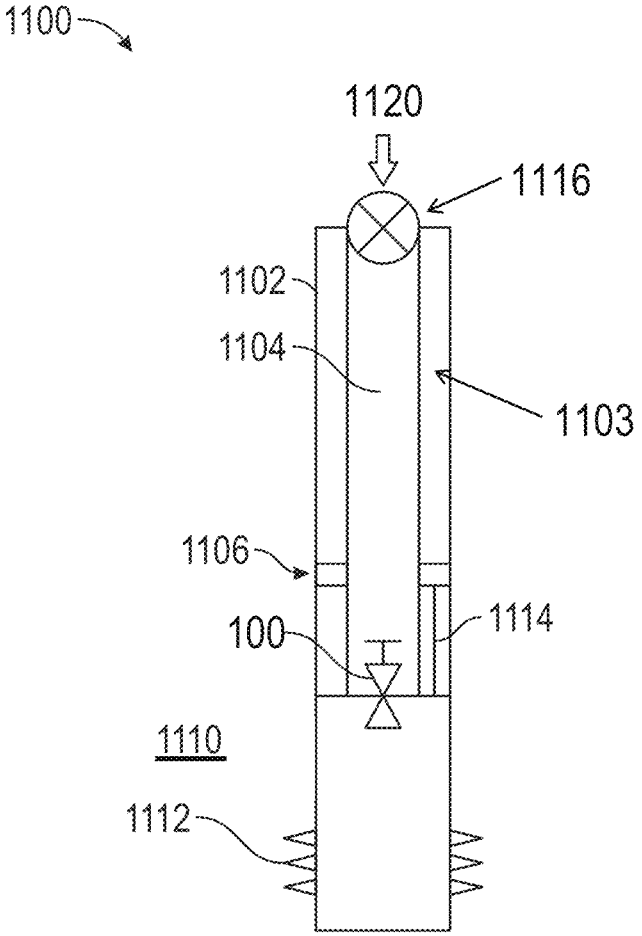
FIG. 11 schematically illustrates an example well completion for fluid injection including a BPV.

The present disclosure provides devices, systems, and methods for fluid injection including a back pressure valve (BPV). FIG. 11 schematically illustrates an example well completion 1100 for fluid injection including a BPV 100. In some configurations, the well is lined with a casing 1102. A tubing 1104 is disposed within the well, for example, within the casing 1102. Perforations 1112 can establish communication with a surrounding reservoir 1110. A packer 1106 can be disposed about the tubing 1104, e.g., radially between the tubing 1104 and casing 1102, to isolate a zone of the well. The BPV 100 can be disposed at or near a bottom of the tubing 1104. A reference pressure path 1114 can establish communication between the BPV 100 and the annulus 1103 or a control line from the surface. In configurations including a packer 1106 as shown in FIG. 11, the reference pressure path 1114 extends through the packer 1106 to place the BPV 100 in fluid communication with the annulus 1103 above the packer 1106 or a control line from the surface. A valve 1116 can be disposed at or near a top of the tubing 1104 and/or at or near a surface location. In use, fluid 1120, e.g., $CO_2$, in a dense state, e.g., liquid or supercritical, is injected through valve 1116 into the tubing 1104, and then through BPV 100 into the reservoir 1110.

Depleted wells into which fluid, such as $CO_2$, may be injected typically do not have high back pressure. The BPV 100 is advantageously positioned and configured such that when injection fluid, e.g., $CO_2$, is delivered down through the tubing 1104, the BPV 100 controls and/or maintains pressure of the injection fluid such that injection fluid above the BPV 100 is maintained at a pressure higher than the liquid to gas transition level of the injection fluid. The BPV 100 maintains a constant differential pressure across a range of injection rates, regulates flow, and facilitates high-capacity $CO_2$ injection. The BPV 100 helps prevent or inhibit the injection fluid from undergoing a fluid phase transition, which would create detrimental cooling to equipment and/or other features of the well.

The BPV 100 can include an ON/OFF (or open/closed) module and/or functionality and a variable choke module and/or functionality. In some configurations, the BPV 100 requires a one-time setting, which may be based on depth, via the reference pressure path 1114 to balance the pressure from $CO_2$ column that exerts high hydrostatic pressure. An injection pressure above a pre-defined threshold opens the valve. Once open, operating pressure keeps the BPV 100 open through-out the injection process. When injection is stopped, a column of $CO_2$ is trapped between the surface injection system, e.g., valve 1116, and the BPV 100. This system offers a distinct advantage over a surface choke or a fixed choke system in which temperatures drop to sub-zero during shut in and transient conditions affecting various other components in the well.

FIGS. 1-10 illustrate various views of an example configuration of BPV 100. The BPV 100 has a housing 150. In the illustrated configuration, the BPV 100 has a three part housing 150*a*, 150*b*, 150*c*. The housing parts 150*a*, 150*b*, 150*c* can be integrally formed or joined together. An end cap 150*d* can be disposed at an upper end of the BPV 100. A piston 170 is disposed within the housing 150, 150*a*. The piston 170 may be a single, integrally formed component, or include two or more components coupled together, as shown in the illustrated configuration. A cavity 164 is defined axially between the end cap 150*d* and the piston 170.

A central bore 160 extends longitudinally or axially within the housing 150, 150*a*, 150*b*, 150*c*, e.g., from the piston 170 to an opening 152 at a bottom end of the BPV 100. Housing 150, 150*a* includes one or more flow ports 154 extending radially therethrough, thereby creating a flow path from an area outside the BPV 100 to the central bore 160. Seals 108, 110 may be disposed radially between the piston 170 and the housing 150. In the illustrated configuration, seal(s) 108 is disposed radially between the piston 170 and an internal wall or surface of housing part 150*a*. Seal 108 may be one or more spring energized seals. Seal(s) 110 is disposed radially between piston 170 and an inner wall or surface of housing part 150*b* defining a portion of the central bore 160 when the BPV 100 is in a closed position, as shown in FIG. 1. Seal(s) 110 may be one or more metal choke seals.

A stopper 104 is disposed within the cavity 164. In the illustrated configuration, the stopper 104 is coupled to and extends downward from the end cap 150*d*. A biasing member or power spring 102 can be disposed radially between the stopper 104 and the housing 150, 150*a*. The power spring 102 can extend axially from the end cap 150*d* to the piston 170.

A stem 130 is disposed within the housing 150, 150*c*. As shown, the stem 130 is disposed below the piston 170. The stem 130 has a stem bore 134 extending axially through the stem 130, e.g., from an upper end wall portion of the stem to an opening 136 at a bottom end of the stem 130. The stem 130 also includes one or more radial ports 138 disposed near the upper end wall of the stem 130, allowing fluid communication between the central bore 160 and the stem bore 134. Seals 116, 122, e.g., spring energized seals, can be disposed radially between the stem 130 and the housing 150*b*, 150*c*, respectively. In some configurations, a spring or biasing member 132 is disposed radially between the stem 130 and the housing 150, 150*c*. In the illustrated configuration, the spring or biasing member 132 extends axially between a radially outwardly extending flange of the stem 130 and an internal shoulder of the housing 150, 150*c*.

In the illustrated configuration, BPV 100 includes a reference pressure port 114. As shown, the reference pressure port 114 can extend from an opening in the outer surface of the housing 150, 150*b*, through the housing 150, 150*b*, 150*a*. As indicated by arrows 115 in FIG. 8, reference pressure flows through reference pressure port 114 to the cavity 164. A plug 106 can close the port 114 on an external surface of housing 150*a*. The reference pressure acts on the top of the piston 170, indicated by 906 in FIG. 9. The reference pressure port 114 opening in the outer surface of the housing 150, 150*b* can be in fluid communication, directly or indirectly, with reference pressure path 1114.

Figure 9:
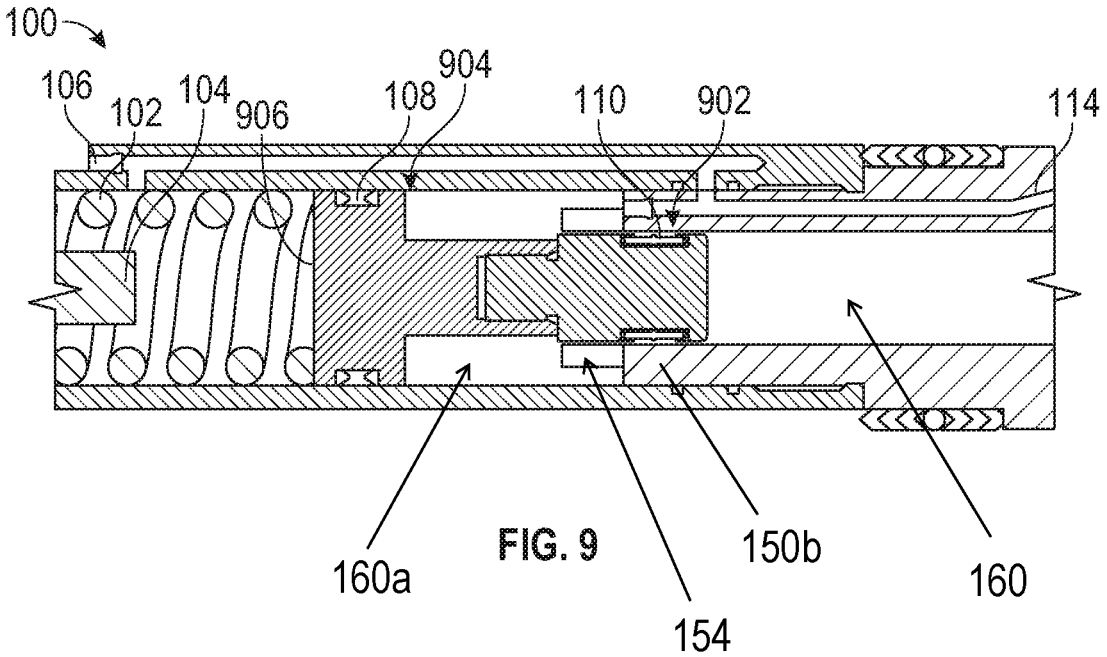
FIG. 9 shows a close up partial longitudinal cross-section of the back pressure valve of FIG. 1 in the closed position.

FIGS. 1 and 9 show the BPV 100 in a closed position. The piston 170 internally seals or blocks a portion of the central bore 160. For example, in the illustrated configuration, the piston 170 is seated in and seals against an internal sealing surface defined by an upper portion of the housing part 150*b* defining the central bore 160, to seal off the central bore 160. Therefore, while fluid may flow into the central bore 160 through flow ports 154, the fluid is held in area 160*a* (shown in FIG. 9) due to piston 170 sealing against housing 150*b*. The power spring 102 can bias the piston 170 toward the closed position. The stem 130, e.g., the upper end wall portion, may be seated against an internally tapered seat 140 of the housing 150, 150*b*, thereby further blocking flow through central bore 160 and preventing or inhibiting fluid communication between central bore 160 and stem bore 134 via radial ports 138. The spring or biasing member 132 can bias the stem 130 to a closed position against the seat 140. In some configurations, a secondary reference pressure port 118 extends through the outer surface of the housing 150*b* to a cavity surrounding the stem 130 and spring 132.

As shown in FIG. 9, the differential pressure area between injection fluid (e.g., CO2), indicated by 904 and 902, and reference pressure (acting against the uphole end of the piston 170, as indicated by 906) helps keep the valve normally closed. A combination of the spring force of power spring 102 and reference pressure can hold the BPV 100 in the closed position. A predetermined opening pressure (e.g., a pressure exceeding the combination of the spring force of power spring 102 and reference pressure) moves the piston 170 uphole (toward the left in the orientation of the figures) creating a flow path for injection fluid into and through the valve 100, for example into the reservoir.

Figure 2:
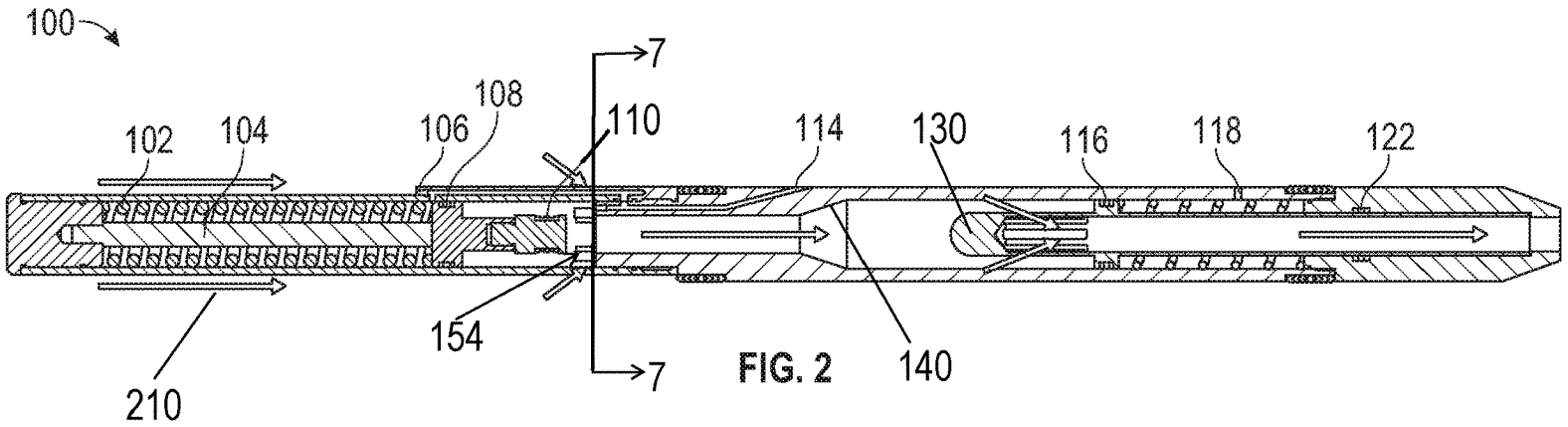
FIG. 2 shows a longitudinal cross-section of the back pressure valve of FIG. 1 in an open position.
Figure 3:
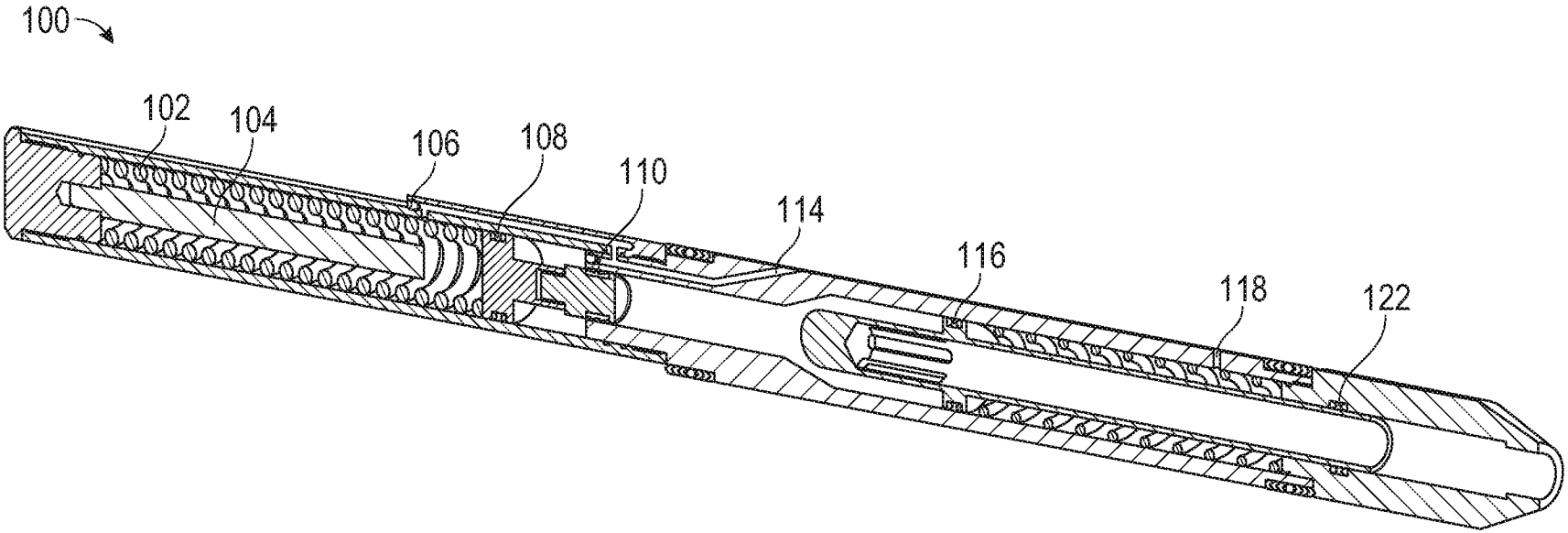
FIG. 3 shows a perspective longitudinal cross-section of the back pressure valve of FIG. 1.
Figure 4:
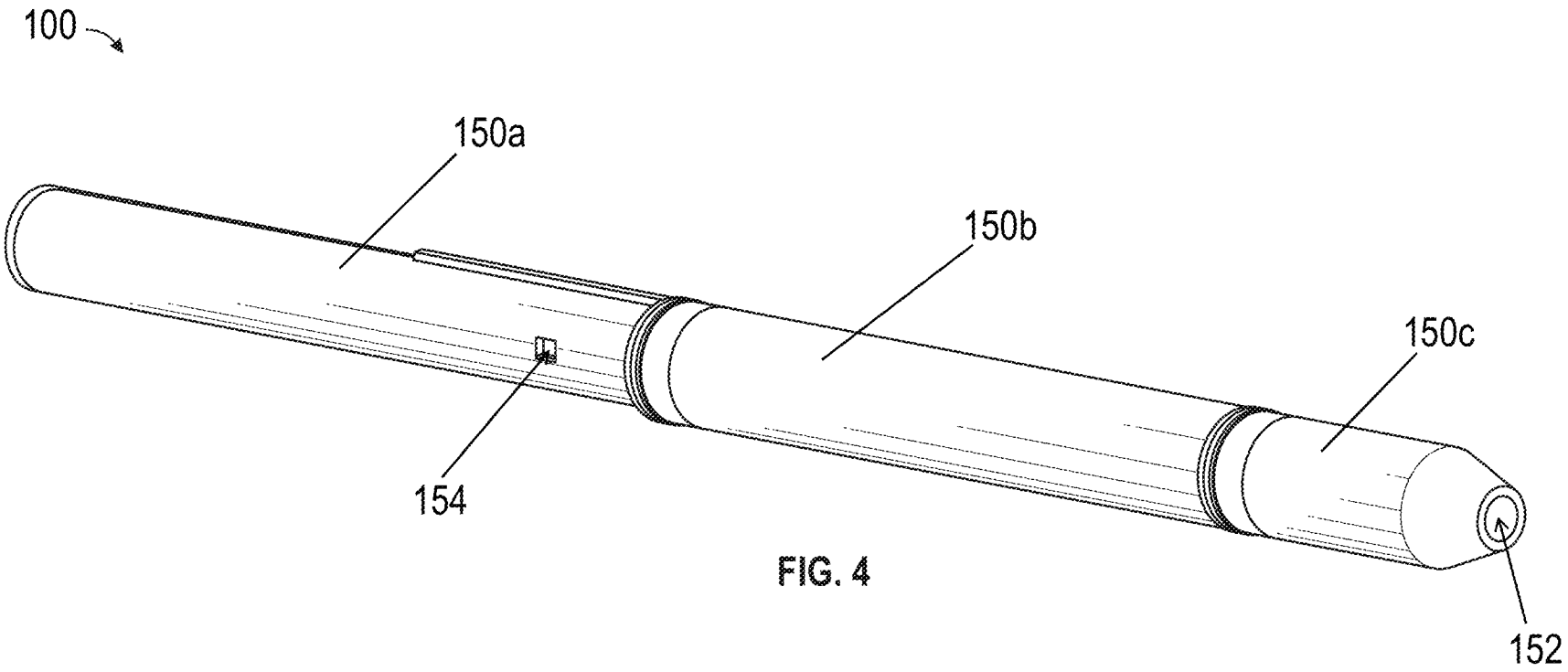
FIG. 4 shows a perspective view of the back pressure valve of FIG. 1.
Figure 7:
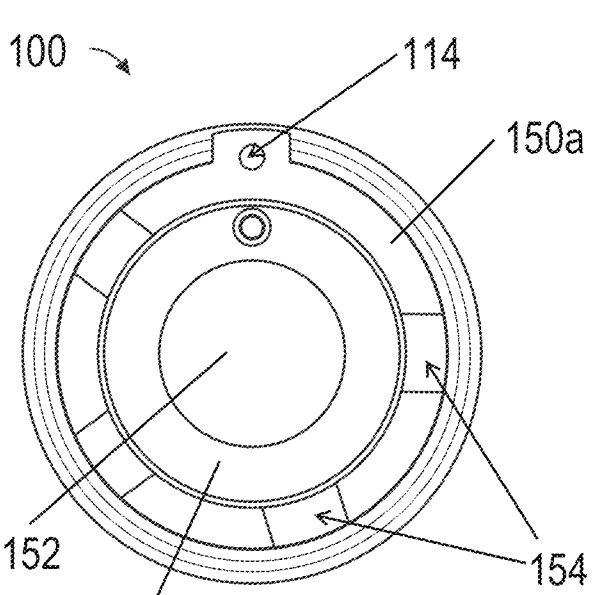
FIG. 7 shows a transverse cross-section of the back pressure valve of FIG. 1, taken along line 7-7 shown in FIG. 2.
Figure 6:
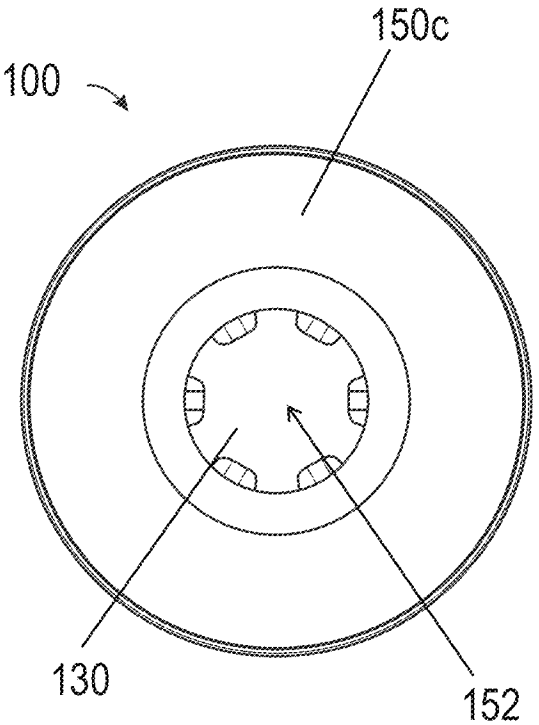
FIG. 6 shows a bottom end view of the back pressure valve of FIG. 1.
Figure 5:
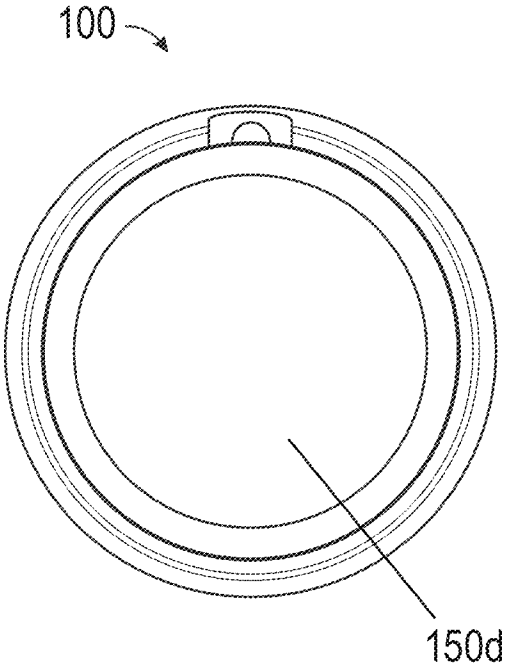
FIG. 5 shows a top end view of the back pressure valve of FIG. 1.
Figure 8:
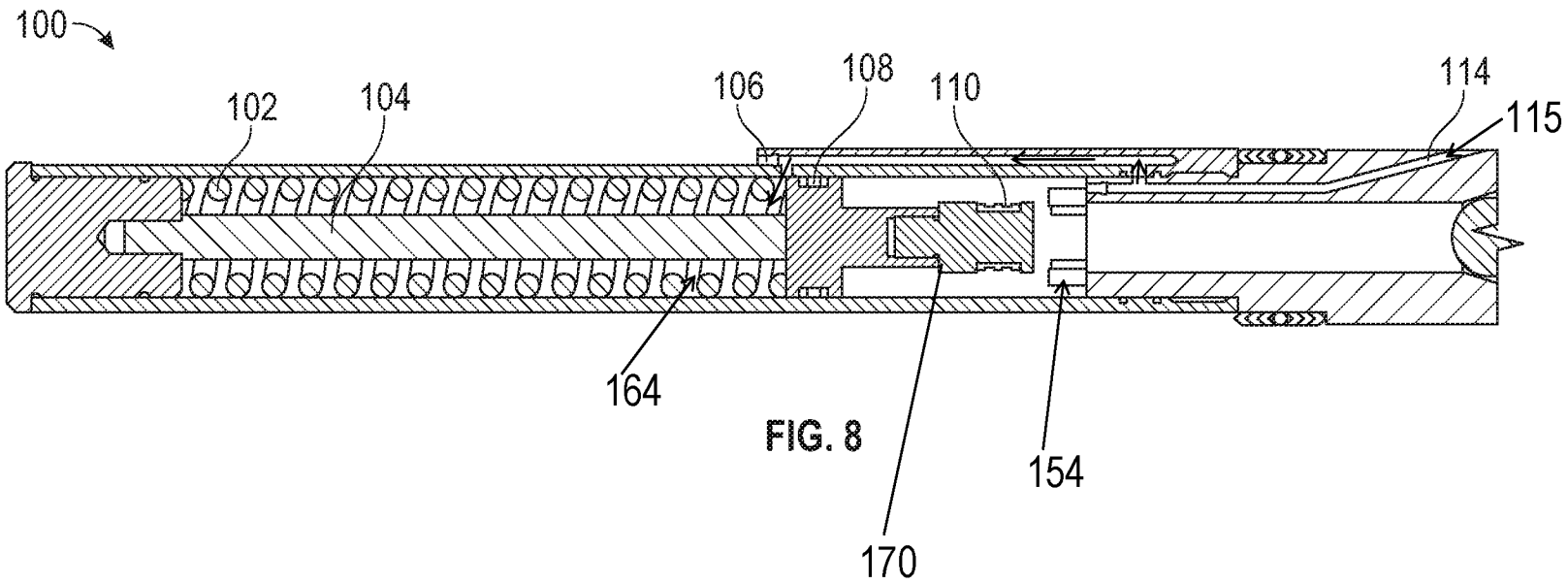
FIG. 8 shows a partial longitudinal cross-section of the back pressure valve of FIG. 1, indicating a reference pressure flow path.
Figure 10:
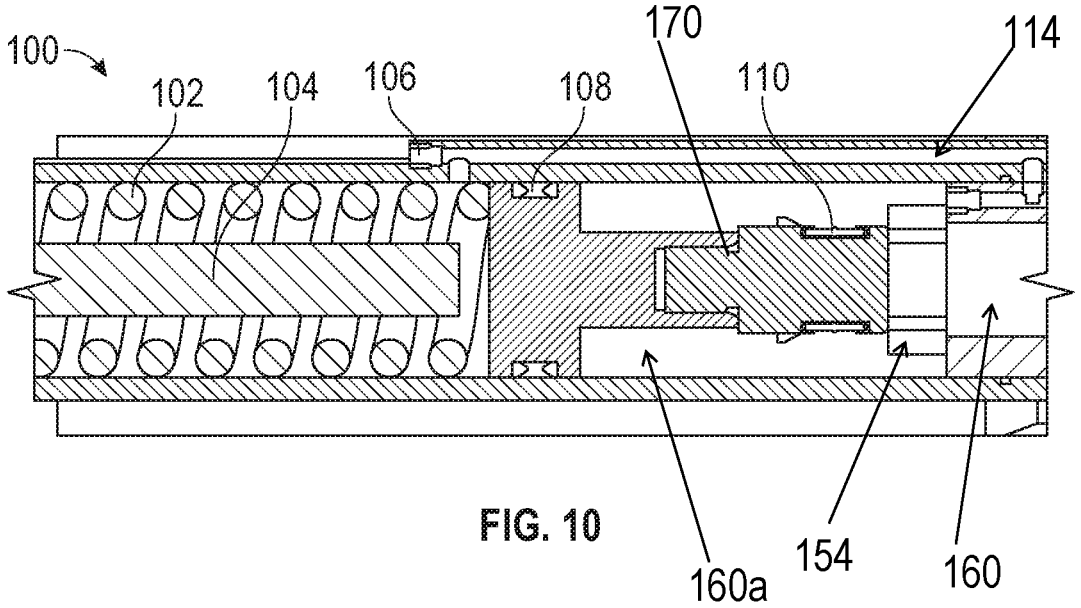
FIG. 10 shows a close up partial longitudinal cross-section of the back pressure valve of FIG. 1 in the open position.

FIGS. 2 and 10 show the BPV 100 in an open position. When the injection pressure, e.g., pressure in area 160*a*, exceeds the determined threshold (e.g., the spring force of power spring 102 plus the reference pressure acting on 906), the piston 170 is shifted upward and moves away from the corresponding sealing surface of housing 150*b* as shown, compressing the power spring 102. The piston 170 can move upwards until the piston 170 contacts the stopper 104. Flow of the injection fluid into and through central bore 160 can shift the stem 130 downward and away from seat 140, compressing spring or biasing member 132, and allowing fluid communication between central bore 160 and radial ports 138. As indicated by arrows 210 in FIG. 2, the injection fluid can then flow through ports 154 into central bore 160, through the radial ports 138 of the stem 130 into stem bore 134, to exit the BPV 100 through opening 152.

In some configurations, shifting and opening of the piston 170 acts as an on/off or open/closed module or functionality. In some configurations, progressive shifting of the stem 130 can act as a variable choke module or functionality. As the stem 130 moves away from the seat 140, a flow area through a portion of the central bore 160 defined by and/or proximate or below the seat 140 increases, thereby acting as a variable choke of flow through the central bore 160. Once the BPV 100 is open, operating pressure can maintain the BPV 100 in the open position over a range of injection rates.

Opening of the BPV 100 increases the volume or pressure area of fluid in area 160*a*, providing additional pressure on the bottom of the piston 170 to help keep the piston 170 open and reduce the pressure needed to continue the injection operation. If the injection pressure falls below that operating pressure, the piston 170 moves down toward and to the closed position, trapping the injection fluid between the surface systems and BPV 100. In the illustrated configuration, if the injection pressure falls below the operating pressure, or the injection pressure falls below the reference pressure acting at 906, the power spring 102 is allowed to expand, moving the piston 170 downward. As flow through central bore 160 is blocked, biasing member or spring 132 can shift the stem 130 back to the seat 140. Pressure is maintained to prevent extreme low temperatures in the well.

In some configurations, the BPV 100 advantageously does not require surface control, and may be passive and autonomous. The BPV 100 is opened and closed via injection pressure. In some configurations, the BPV 100 can be conveyed by wireline, and may be deployed into a landing nipple attached to the tubing 1104. The BPV 100 is therefore retrievable for maintenance and/or replacement as desired or required. In some configurations, the BPV 100 does not require monitoring devices. When the flowing pressure is reduced below a predefined value or range, the BPV 100 closes quickly to maintain the required pressure to keep the fluid in the liquid state.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A back pressure valve comprising:

a housing defining a central bore, the central bore extending to an opening in a downhole end of the housing, the housing comprising an internal sealing surface and an internal seat;

a piston disposed in the housing and configured to seal against the internal sealing surface when the back pressure valve is in a closed position;

a power spring disposed in the housing and operably coupled to the piston, the power spring configured to bias the piston against the internal sealing surface;

a stem disposed within the housing and configured to seal against the internal seat when the back pressure valve is in the closed position;

a reference pressure port extending through the housing from an opening in an external wall of the housing to a chamber on an uphole end of the piston such that a reference pressure acts on the uphole end of the piston, the opening in the external wall of the housing in communication with an annulus pressure or a control line from a surface location; and one or more flow ports in the housing, the flow ports configured to allow injection fluid to flow from outside of the back pressure valve into the central bore, wherein the back pressure valve is configured to move to an open position when a pressure of the injection fluid exceeds a combination of the reference pressure and a spring force of the power spring.

2. The back pressure valve of claim 1, wherein when the pressure of the injection fluid exceeds the combination of the reference pressure and the spring force of the power spring, the piston shifts away from the internal sealing surface to open the back pressure valve.

3. The back pressure valve of claim 1, wherein when the back pressure valve is in the open position, the back pressure valve can remain open over a range of injection pressures, such that an operating injection pressure can be less than a pressure required to move the back pressure valve to the open position.

4. The back pressure valve of claim 1, wherein in the open position, a flow path for the injection fluid extends through the flow ports into the central bore, through the stem, and through the opening in the downhole end of the housing.

5. The back pressure valve of claim 1, wherein when the back pressure valve is in the open position, the stem and internal seat interact to function as a variable choke.

6. The back pressure valve of claim 5, wherein as an operating injection pressure increases, the stem moves farther away from the internal seat, increasing a flow area through the central bore.

7. The back pressure valve of claim 1, further comprising a biasing member disposed about the stem and configured to bias the stem toward the internal seat.

8. A system for injecting a fluid into a well or aquifer, the system comprising:

a tubing extending into or to the well or aquifer;

the back pressure valve of claim 1 disposed at or near a lower end of the tubing; and a reference pressure path providing communication between the opening of the reference pressure port of the back pressure valve and an annulus outside the tubing or the control line from a surface location.

9. The system of claim 8, wherein the system is configured for injection of $CO_2$.

10. The system of claim 8, further comprising a valve disposed at or near an upper end of the tubing, the valve configured to allow injection of the fluid into the tubing in use.

11. The system of claim 8, wherein the back pressure valve is configured to maintain a pressure sufficient to maintain the fluid in the tubing in a dense state.

* * * * *